United States Patent [19]

Smith

[11] Patent Number: 5,036,613

[45] Date of Patent: Aug. 6, 1991

[54] PORTABLE GUN RANGE APPARATUS

[76] Inventor: Amos C. Smith, 3550 Westbrook Dr., S. E., Smyrna, Ga. 30082

[21] Appl. No.: 459,200

[22] Filed: Dec. 29, 1989

[51] Int. Cl.[5] ..... F41J 5/14; F41A 35/00; F41C 27/00

[52] U.S. Cl. ..... 42/94; 33/756; 273/392

[58] Field of Search ..... 42/94; 273/390-392, 273/404; 33/756, 761

[56] References Cited

U.S. PATENT DOCUMENTS

| | | | |
|---|---|---|---|
| 163,410 | 5/1875 | Reisinger | 33/761 |
| 296,504 | 4/1884 | Atkins | 33/756 |
| 687,873 | 12/1901 | Daniels | 273/390 |
| 879,052 | 2/1908 | Jeranek | 42/94 |
| 2,113,719 | 4/1938 | Creswell | 273/390 |
| 2,870,683 | 1/1959 | Wilson | 89/40.02 |
| 3,225,656 | 12/1965 | Flaherty et al. | 42/94 |
| 3,703,046 | 11/1972 | Barone et al. | 42/94 |
| 4,265,045 | 5/1981 | Garbini | 42/94 |
| 4,501,082 | 2/1985 | Phillips et al. | 42/94 |
| 4,535,559 | 8/1985 | Hall | 42/94 |
| 4,563,829 | 1/1986 | Bozick | 42/94 |
| 4,714,256 | 12/1987 | Mosser | 273/392 |
| 4,819,337 | 4/1989 | Noyes | 33/756 |
| 4,913,389 | 4/1990 | McCracken | 273/407 |
| 4,7602,029 | 10/1987 | DeVaul et al. | 42/94 |

*Primary Examiner*—David H. Brown
*Attorney, Agent, or Firm*—Leon Gilden

[57] ABSTRACT

An apparatus is set forth including a vertically adjustable gun and support member, with a plurality of targets aligned forwardly thereof, wherein a flexible line including yard markers at equal predetermined spaced intervals is mounted on the line for positioning of the targets forwardly of the gun support member. The gun support member includes a tripod arrangement formed with a central, vertical support rod mounting the gun, wherein the gun is further pivotally mounted to the support rod. A lowermost end of the rod includes a retraction and dispensing reel associated with the flexible line. Each of the targets is provided with concentric rings mounted for rotation upon being struck by a projectile from the target gun.

9 Claims, 4 Drawing Sheets

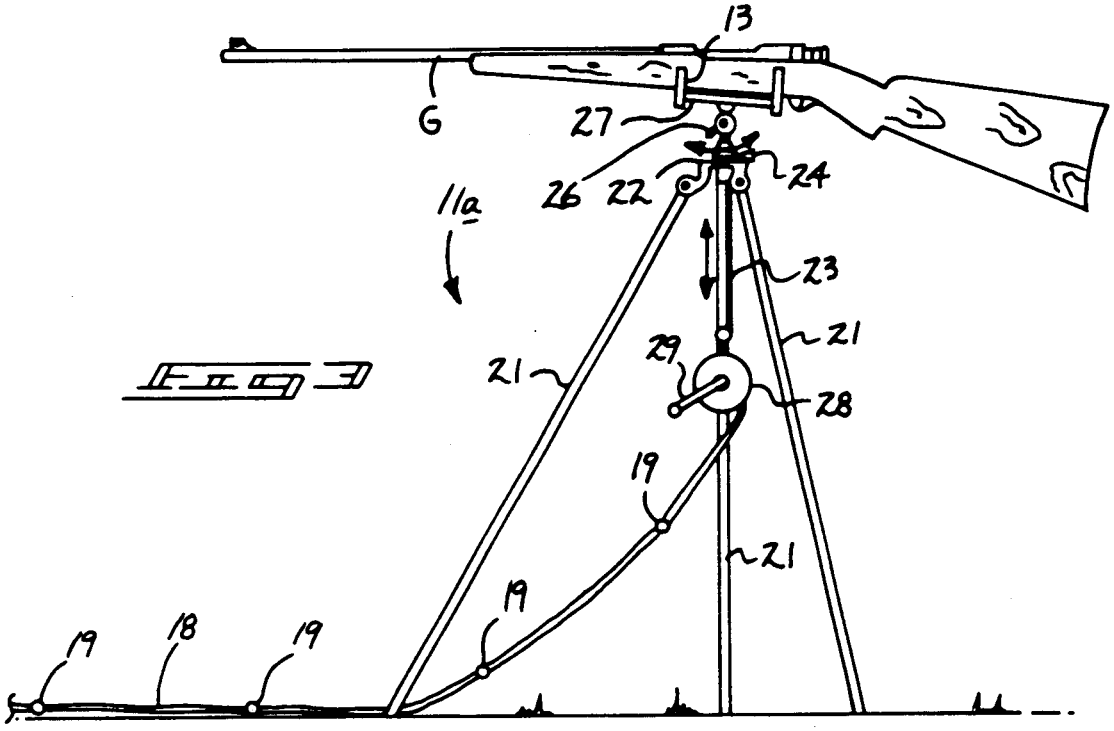
Fig 3
Fig 4
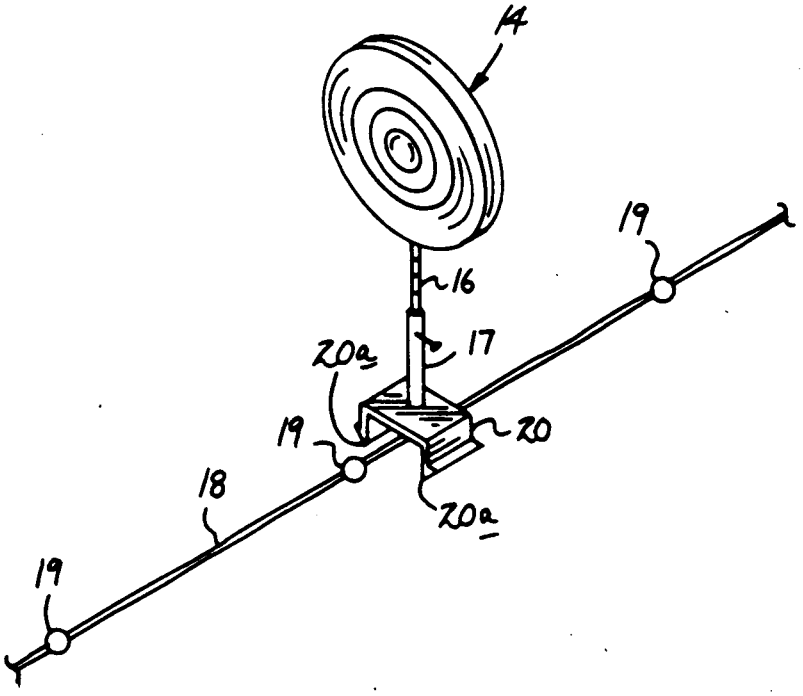

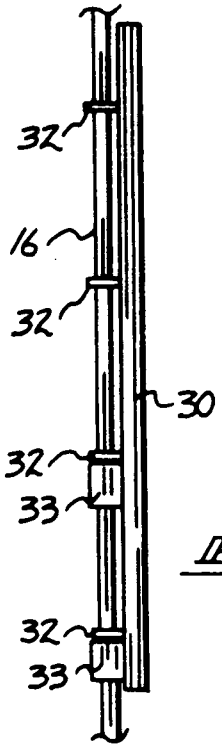
Fig 6
Fig 7
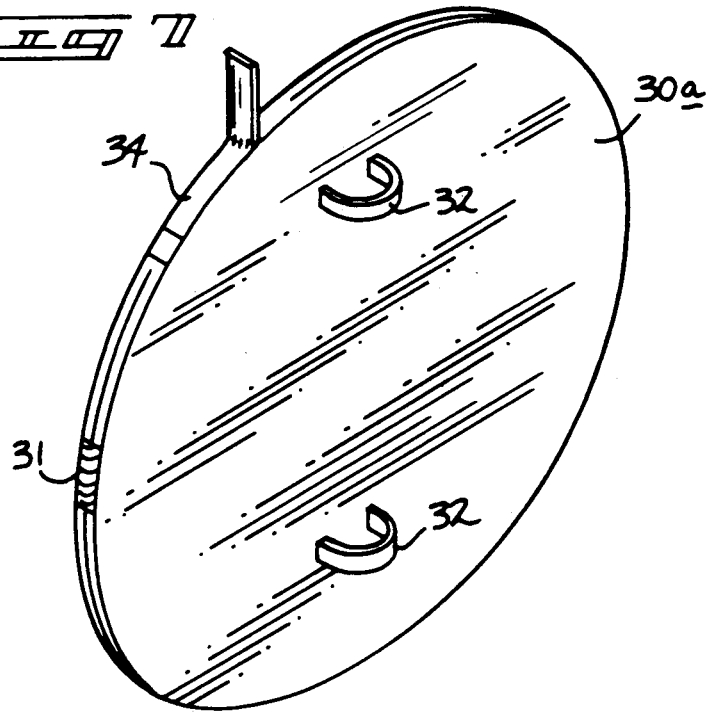

PORTABLE GUN RANGE APPARATUS

BACKGROUND OF THE INVENTION

1. Field of the Invention

The field of invention relates to target apparatus, and more particularly pertains to a new and improved portable gun range apparatus wherein the same provides for portable arrangement of a gun target range, as desired by an individual.

2. Description of the Prior Art

The use of target apparatus, particularly with firearms, is well known in the prior art. The gun ranges conventionally utilized are frequently experiencing crowded conditions requiring undue delay be individuals in awaiting an available target and associated user fees discouraging many individuals from the safe and desired practice associated with firearms. Examples of the prior art gun support arrangements may be found in U.S. Pat. No. 2,807,683 to Wilson providing a tripod arrangement pivotally mounting a gun at an upper end thereof.

U.S. Pat. No. 4,535,559 to Hall provides a portable table and seat for use in a seating position in the firing of guns and the like.

U.S. Pat. No. 4,501,082 to Phillips, et al., wherein a shooting bench is provided with collapsible legs mounting a shooting bench and a forwardly positioned pad for providing elevation in use of the gun.

U.S. Pat. No. 4,563,829 to Bozick provides a shooting bench particularly for use with hand guns, wherein a hinged block, including a "V" shaped notch, is mounted forwardly of a support bench with a rest pad mounted rearwardly thereof. The support bench is mounted spaced vertically by use of a multi-leg support arrangement.

U.S. Pat. No. 4,702,029 to DeVaul wherein the patent provides a gun case which is utilized as a shooter's bench utilizing leg members attachable thereto, with a forwardly positioned support rest to enable use of the organization as a portable gun support bench.

As such, it may be appreciated that there is a continuing need for a new and improved portable gun range apparatus wherein the same addresses both the problems of ease of use, and well as portability and effectiveness in construction and in this respect, the present invention substantially fulfills this need.

SUMMARY OF THE INVENTION

In view of the foregoing disadvantages inherent in the known types of portable gun rests now present in the prior art, the present invention provides a portable gun range apparatus wherein the same is selectively transported and assembled at various predesired positions for use as a gun range. As such, the general purpose of the present invention, which will be described subsequently in greater detail, is to provide a new and improved portable gun range apparatus which has all the advantages of the prior art gun support apparatus and none of the disadvantages.

To attain this, the present invention includes an apparatus setting forth a vertically adjustable gun and support member, with a plurality of targets aligned forwardly thereof, wherein a flexible line including yard markers at equal predetermined spaced intervals is mounted on the line for positioning of the targets forwardly of the gun support member. The gun support member includes a tripod arrangement formed with a central, vertical support rod mounting the gun, wherein the gun is further pivotally mounted to the support rod. A lowermost end of the rod includes a retraction and dispensing reel associated with the flexible line. Each of the targets is provided with concentric rings mounted for rotation upon being struck by a projectile from the target gun.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable gun range apparatus which has all the advantages of the prior art gun range apparatus and none of the disadvantages.

It is another object of the present invention to provide a new and improved portable gun range apparatus which may be easily and efficiently manufactured and marketed.

It is a further object of the present invention to provide a new and improved portable gun range apparatus which is of a durable and reliable construction.

An even further object of the present invention is to provide a new and improved portable gun range apparatus which is susceptible of a low cost of manufacture with regard to both materials and labor, and which accordingly is then susceptible of low prices of sale to the consuming public, thereby making such portable gun range apparatus economically available to the buying public.

Still yet another object of the present invention is to provide a new and improved portable gun range apparatus which provides in the apparatuses and methods of the prior art some of the advantages thereof, while simultaneously overcoming some of the disadvantages normally associated therewith.

Still another object of the present invention is to provide a new and improved portable gun range apparatus wherein the same includes a multi-target range easily and readily assembled at preselected distances from a support tripod.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view taken in elevation of a further support member utilized by the instant invention.

FIG. 4 is an isometric illustration of a target and line marker arrangement utilized by the instant invention.

FIG. 6 is a sectional orthographic side view of the target of FIG. 5 illustrating a securement to the associated telescoping target rod.

FIG. 7 is a rear isometric illustration of the center disk utilized by the target of the instant invention.

DESCRIPTION OF THE PREFERRED EMBODIMENT

Figures 1, 2:
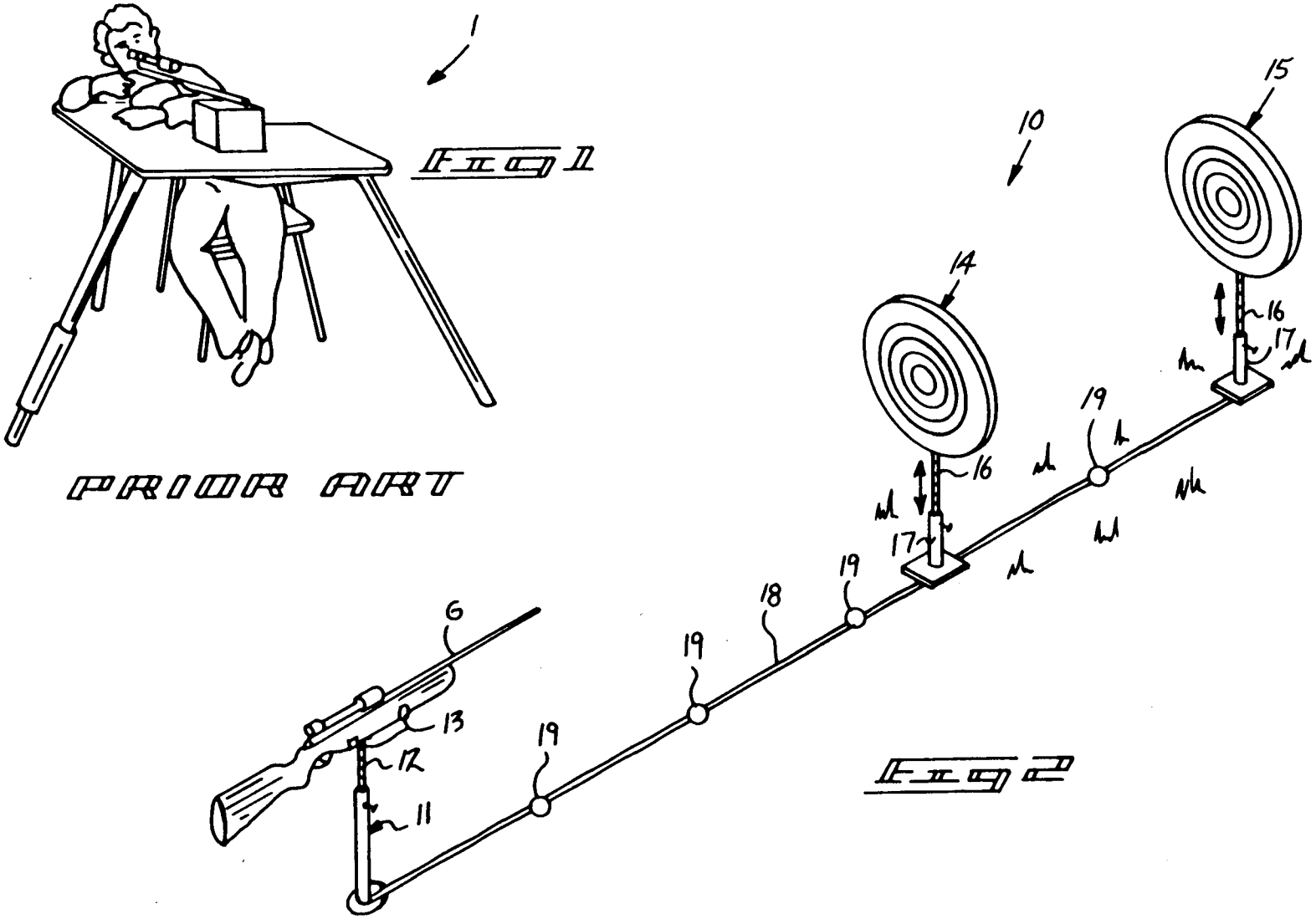
FIG 1 PRIOR ART
FIG. 1 is an isometric illustration of a typical prior art gun support apparatus.
FIG. 2 is an isometric illustration of the instant invention.

With reference now to the drawings, and in particular to FIGS. 1 to 7 thereof, a new and improved portable gun range apparatus embodying the principles and concepts of the present invention and generally designated by the reference numeral 10 will be described.

FIG. 1 is illustrative of a typical prior art gun support arrangement that is conventionally utilized at designated target ranges, wherein a support table is provided with a forward rest for mounting a gun thereof during an aiming and firing procedure.

More specifically, the portable gun range apparatus 10 of the instant invention essentially comprises an adjustable support member 11 formed with a telescoping coaxially aligned shaft 12 and provided with a pair of spaced support arms 13 to provide support for a gun "G" thereon. A respective first and second target 14 and 15 are vertically adjustable and spaced from the support member 11, wherein each of the targets are provided with a vertically telescoping target rod 16 providing adjustment apertures to be received within a support stand 17, wherein the apertures may selectively receive a pin therethrough to vertically lock the target rod 16 relative to the support stand 17. An elongate flexible line 18 is mounted to the support member 11 and includes equally spaced, enlarged markers 19 mounted at predetermined spaced intervals to the line 18. The intervals may be in the range of ten to fifty yards to provide gradations to provide spacing of the targets 14 and 15 in use. The markers are fixedly mounted to the line 18 and are of an enlarged configuration relative to the line 18 to enable visual determination of the proper spacing of the targets 14 and 15 even at greater distances.

FIG. 4 illustrates a typical first target 14 utilized by the instant invention, wherein a "U" shaped support bracket 20 mounts the support stand and pin 17 orthogonally thereon to a top surface of the downwardly extending "U" shaped support bracket 20. Spiked lower terminal ends 20*a* of the downwardly depending legs of the bracket 20 are provided to enable a convenient directing of the bracket 20 within a support surface, such as turf or bare ground and the like.

A further support member 11*a* is preferably utilized in lieu of support 11, as illustrated in FIG. 3, wherein tripod legs 21 are mounted to a tripod base 22 about pivot connections. A vertically repositionable support rod 23 is vertically received through the tripod base 22 and locked in position by a friction lock 24. Further, the support arms 13 mounted to an associated support plate member 27 are pivotally mounted to the tripod base 22 utilizing a further frictional lock member 26 to provide rotative adjustment of the gun "G" relative to the base 22.

A retraction and dispensing reel member 28 provided with a rotatable handle 29 for the dispensing and retraction of the flexible line 18 and the associated enlarged markers 19 surmounted about the line 18. The positioning of the reel member 28 at a lowermost terminal end of the support rod 23 accurately positions the targets, per the illustration in FIG. 2, at accurate distances utilizing the flexible line 18 and the marker member 19 associated therewith.

Figure 5:
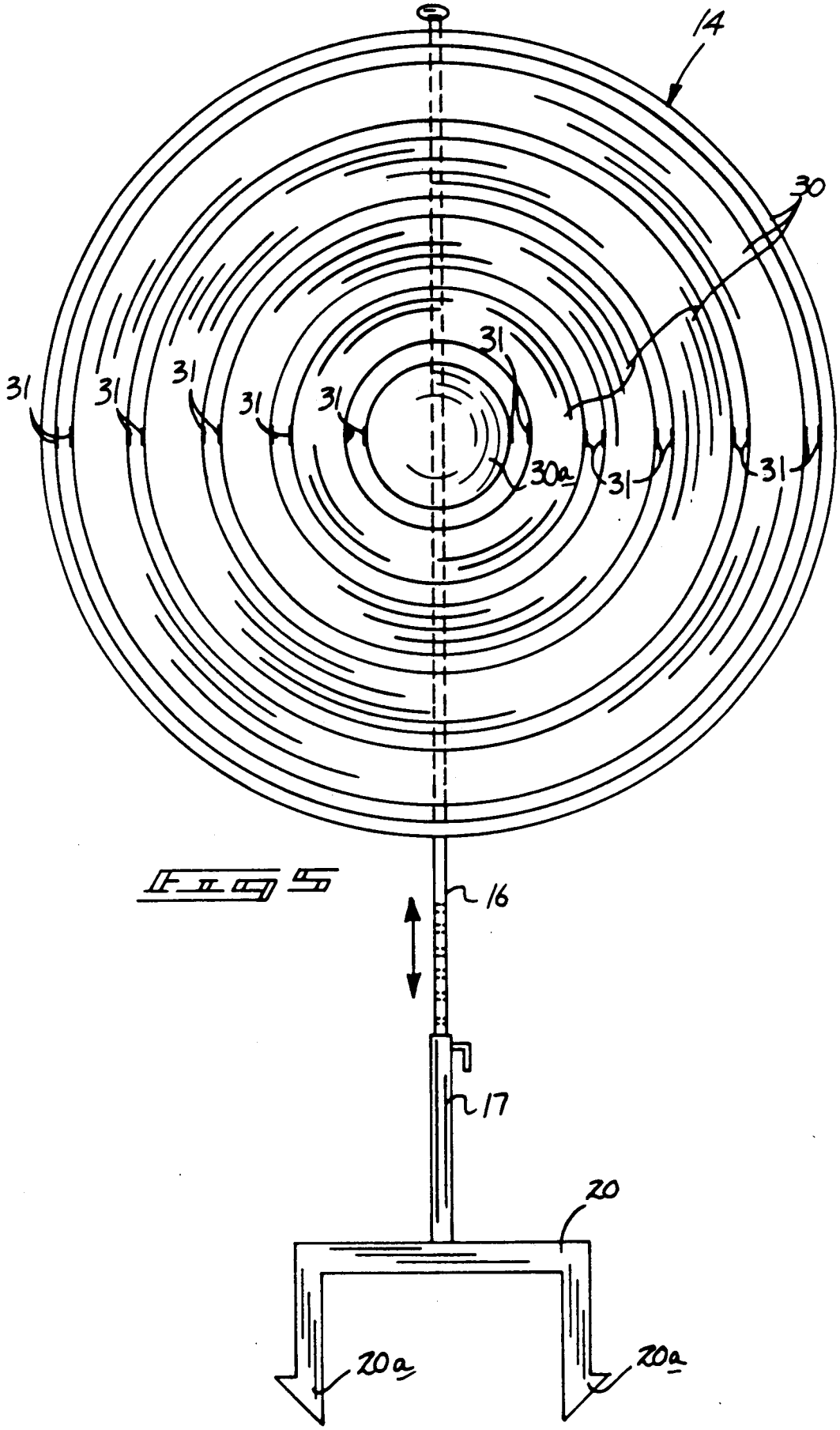
FIG. 5 is an orthographic view taken in elevation of a target utilized by the instant invention.

FIG. 5 is illustrative of a target utilized by the instant invention, wherein the first target 14 is illustrated for purposes of example but understood that the second target 15 is of an equal configuration. Coaxially mounted annular rings 30 are pivotally mounted about their vertical axis and secured to the rod 16. A center disk 30*a* is mounted coaxially and centrally of the target. Diametrically aligned confronting magnet pairs 31 are mounted to circumferential side surfaces of each of the rings 31 and the central disk 30*a* to maintain the rings and the disk in an aligned configuration at the outset of a target shooting event. Upon the striking of one of the rings or the disks 30 and 30*a* respectively, the members will spin to indicate the positioning of the bullet strike. It is of course understood that conventional paper targets may be utilized in addition to the or in substitute for the first and second target members 14 and 15, wherein a paper target may be simply supported on a substitute support rod 16.

FIG. 6 illustrates the mounting of the rings and central disk utilizing "U" shaped rings 32 orthogonally mounted to rear surfaces of the associated target rings and central disk and encompassing the target rod 16. The "U" rings 32 defining a spacing substantially equal to that to complementarily receive the target rod 16 therethrough, wherein the "U" rings 32 are positioned at predetermined vertical orientations relative to the target rod 16 as they rest upon enlarged, diameter boss members 33 to support the rings 32 rotatably about the target rods 16 to enable their spinning thereabout.

FIG. 7 illustrates the central target disk 30*a* wherein to enhance its visibility during a spinning procedure upon being struck by a projectile, a reflective silvered tape 34 is mounted about the circumferential side surface of the target disk 34, as illustrated in FIG. 7, but it is understood that this tape will underlie the associated magnet 31 that maintains the disks and the rings in an initial planar aligned relationship.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable gun range apparatus comprising, in combination, a gun support member including a support base, and a support rod vertically and slidably received through the support base, and a plate member pivotally mounted to the support rod spaced support arms fixedly mounted to and directed upwardly relative to the plate member to cradle and mount a gun thereon, and a flexible indicator line means including a rear end portion wherein the rear end portion is mounted to the support member for visual indication of at least one predetermined distance spacing from the support member, and at least one target member receiving and overlying the flexible indicator line therethrough positioned at the predetermined distant spacing.

2. An apparatus as set forth in claim 1 wherein the support member is defined as a tripod, wherein three legs defining the tripod are pivotally mounted to the support base, and the support rod directed through the support base includes a friction lock to frictionally secure and engage the support rod at a predetermined elevation relative to the support base.

3. An apparatus as set forth in claim 2 wherein a retraction and dispensing reel member is mounted to a lower terminal end of the support rod, the reel member rotatably winding and extending the flexible line housed within the reel member, and the flexible line including a series of equally spaced enlarged markers surmounted about the flexible line at spaced predetermined intervals.

4. An apparatus as set forth in claim 3 wherein the target member includes a "U" shaped support bracket, the bracket defined by downwardly extending legs, each lower terminal end of each leg is formed as a sharpened spike to enable implanting of the legs within a support surface, and a support stand integrally and orthogonally mounted to a top surface of the support bracket, the support stand telescopingly receiving a target rod therewithin.

5. An apparatus as set forth in claim 4 wherein the target rod includes a target device pivotally mounted thereon.

6. An apparatus as set forth in claim 5 wherein the target device includes a series of coaxially spaced annular rings, located axially of the coaxially rings is a central disk, the central disk and the coaxial rings rotatably mounted about the target rod.

7. An apparatus as set forth in claim 6 wherein plural pairs of aligned magnets are mounted to confronting side circumferential edge surfaces of each of the target rings and the target disk to initially maintain and align in a coplanar relationship the target rings and target disk.

8. An apparatus as set forth in claim 7 wherein each of the target rings and the target disk include a plurality of vertically spaced and aligned "U" rings, the "U" rings complementarily receiving the target rod therethrough, the target rod including a series of target bosses defined by a target boss diameter greater than that of a diameter defined by the target rod, the target bosses mounting a "U" shaped ring thereon from each of the target rings and the target disk to enable rotation and positioning of the target rings and target disk about the target rod.

9. An apparatus as set forth in claim 8 wherein the target disk further includes a reflective tape mounted about the circumferential side surface of the target disk underlying the magnets, the reflective tape enabling visual observation of rotation of the target disk upon impacting thereon by a projectile.

* * * * *